US011723442B2

(12) United States Patent
Jamaludin

(10) Patent No.: US 11,723,442 B2
(45) Date of Patent: Aug. 15, 2023

(54) REMOVABLE PRINTABLE AND EMBROIDERABLE BADGE SYSTEM FOR BODY ARMOR CARRIER

(71) Applicant: Point Blank Enterprises, Inc., Pompano Beach, FL (US)

(72) Inventor: Shamshuddeen Junior Jamaludin, Tamarac, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 15 days.

(21) Appl. No.: 17/235,108

(22) Filed: Apr. 20, 2021

(65) Prior Publication Data

US 2021/0321727 A1 Oct. 21, 2021

Related U.S. Application Data

(60) Provisional application No. 63/013,149, filed on Apr. 21, 2020.

(51) Int. Cl.

| | |
|---|---|
| ***A44C 3/00*** | (2006.01) |
| ***A44B 1/18*** | (2006.01) |
| *A41D 1/04* | (2006.01) |
| *F41H 1/02* | (2006.01) |

(52) U.S. Cl.

CPC ..... *A44C 3/001* (2013.01); *A44B 1/185* (2013.01); *A41D 1/04* (2013.01); *F41H 1/02* (2013.01)

(58) Field of Classification Search

CPC ..... A44C 3/001; A44B 1/185; A41D 1/04; A41D 29/00; A41D 27/08; F41H 1/02; Y10T 24/13; G09F 21/02; G09F 21/023; G09F 21/026

USPC ..... 40/1.5, 1.6; 33/653

See application file for complete search history.

(56) References Cited

U.S. PATENT DOCUMENTS

| | | | | |
|---|---|---|---|---|
| 2,441,002 A * | 5/1948 | Berglund | A44C 3/001 | 40/1.6 |
| 6,115,948 A * | 9/2000 | Mitchell | A41D 27/08 | 2/245 |
| 7,327,217 B2 * | 2/2008 | Carter | G06K 19/02 | 340/8.1 |
| 2010/0024173 A1 * | 2/2010 | Cho | G09F 7/12 | 24/3.1 |

* cited by examiner

*Primary Examiner* — Gary C Hoge

(74) *Attorney, Agent, or Firm* — Geoffrey Lottenberg; Berger Singerman LLP

(57) ABSTRACT

A badge system for a shirt carrier or like body armor carrying includes an attachment panel and a badge flap removably attached to the attachment panel. A retention tab is located at the top of the attachment panel such that the top edge of the badge is sandwiched between the strap and the attachment panel to secure the badge to the carrier. The badge flap is printable and embroiderable or may be used a surface on which badges or other items can be attached. The badge flaps can be conveniently printed or embroidered in bulk, avoiding the difficulties associated with printing or embroidering directly on the shirt carrier.

7 Claims, 3 Drawing Sheets

REMOVABLE PRINTABLE AND EMBROIDERABLE BADGE SYSTEM FOR BODY ARMOR CARRIER

CROSS REFERENCE TO RELATED APPLICATIONS

This application claims the benefit of U.S. Provisional Patent Application No. 63/013,149, filed Apr. 21, 2020, which is incorporated herein by reference in its entirety.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the badge system of the present invention. It will be apparent, however, to one skilled in the art that the badge system may be practiced without some of these specific details. Throughout this description, the embodiments and examples shown should be considered as exemplars, rather than as limitations on the badge system. That is, the following description provides examples, and the accompanying drawings show various examples for the purposes of illustration. However, these examples should not be construed in a limiting sense as they are merely intended to provide examples of the badge system rather than to provide an exhaustive list of all possible implementations of the badge system.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Figure 1:
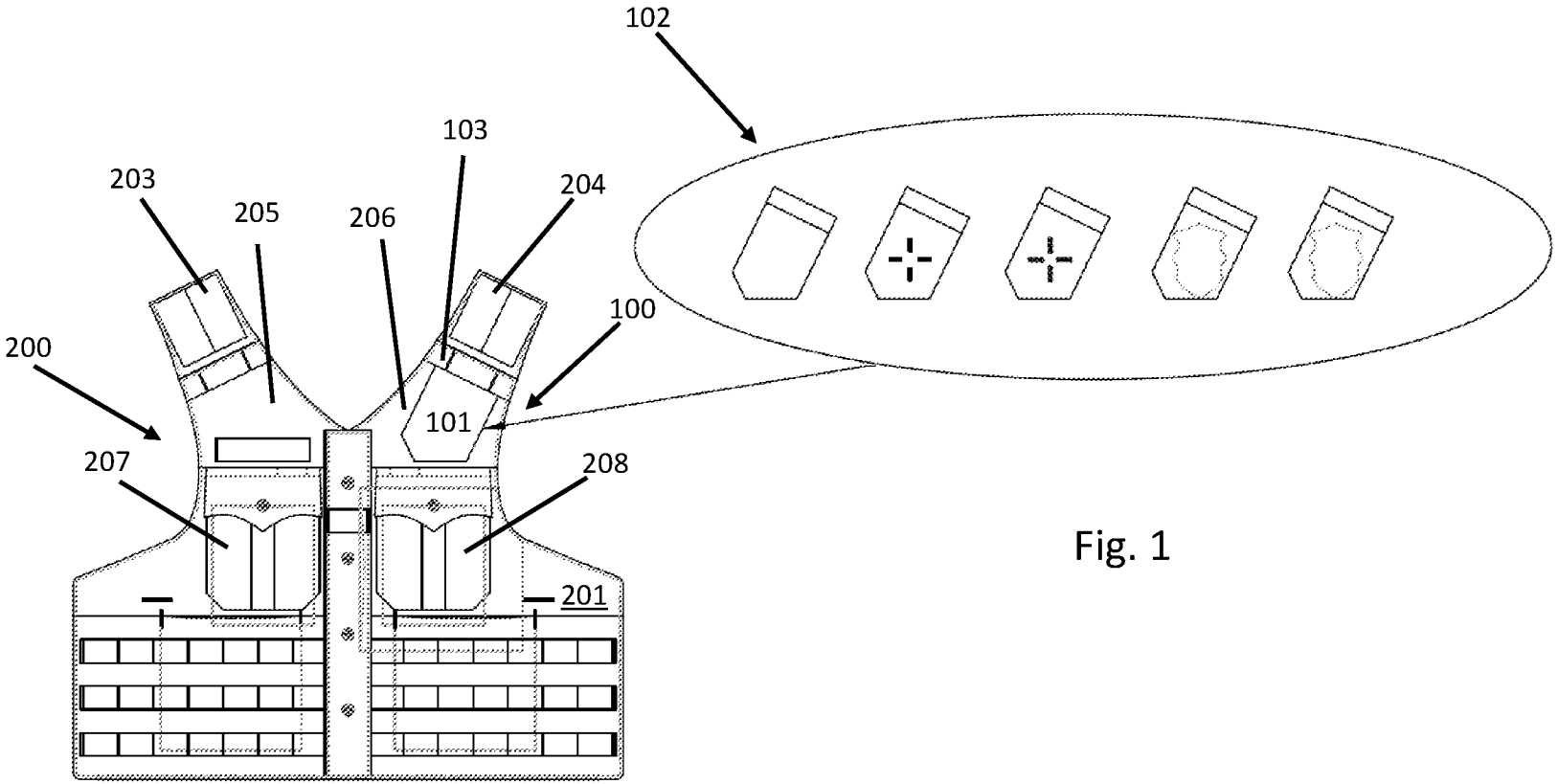
FIG. 1 is a front view of the badge system incorporated into an exemplary uniform shirt carrier.
Figure 2A:
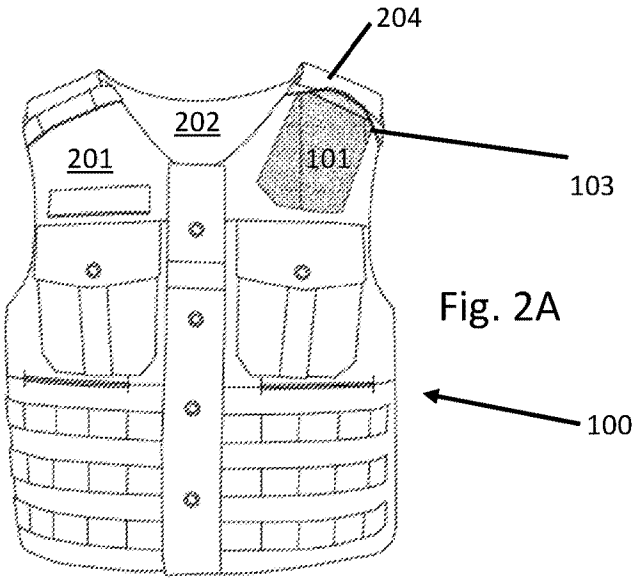
FIG. 2A is a perspective view of the badge system incorporated into an exemplary uniform shirt carrier.
Figure 2C:
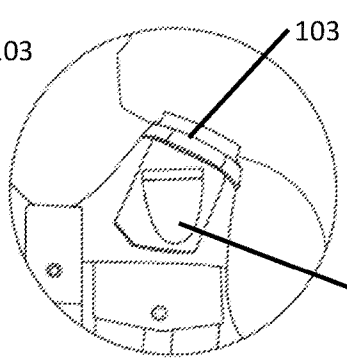
FIG. 2C is a close-up of the badge flap installed on the attachment panel.
Figure 2B:
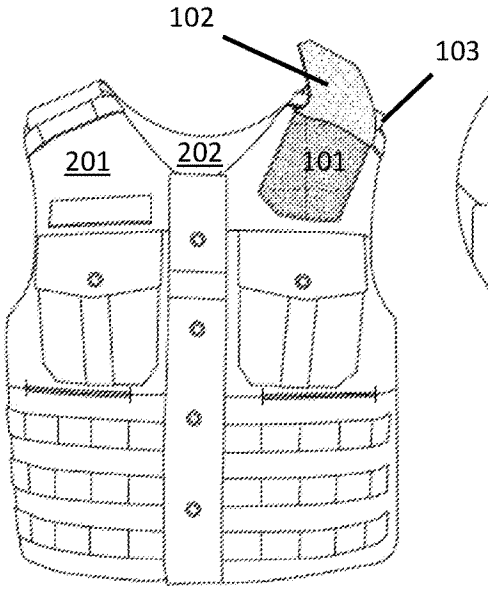
FIG. 2B is another perspective view of the badge system incorporated into an exemplary uniform shirt carrier, showing the installation of the badge flap.
Figures 3A, 3B, 3C, 3D, 3E:
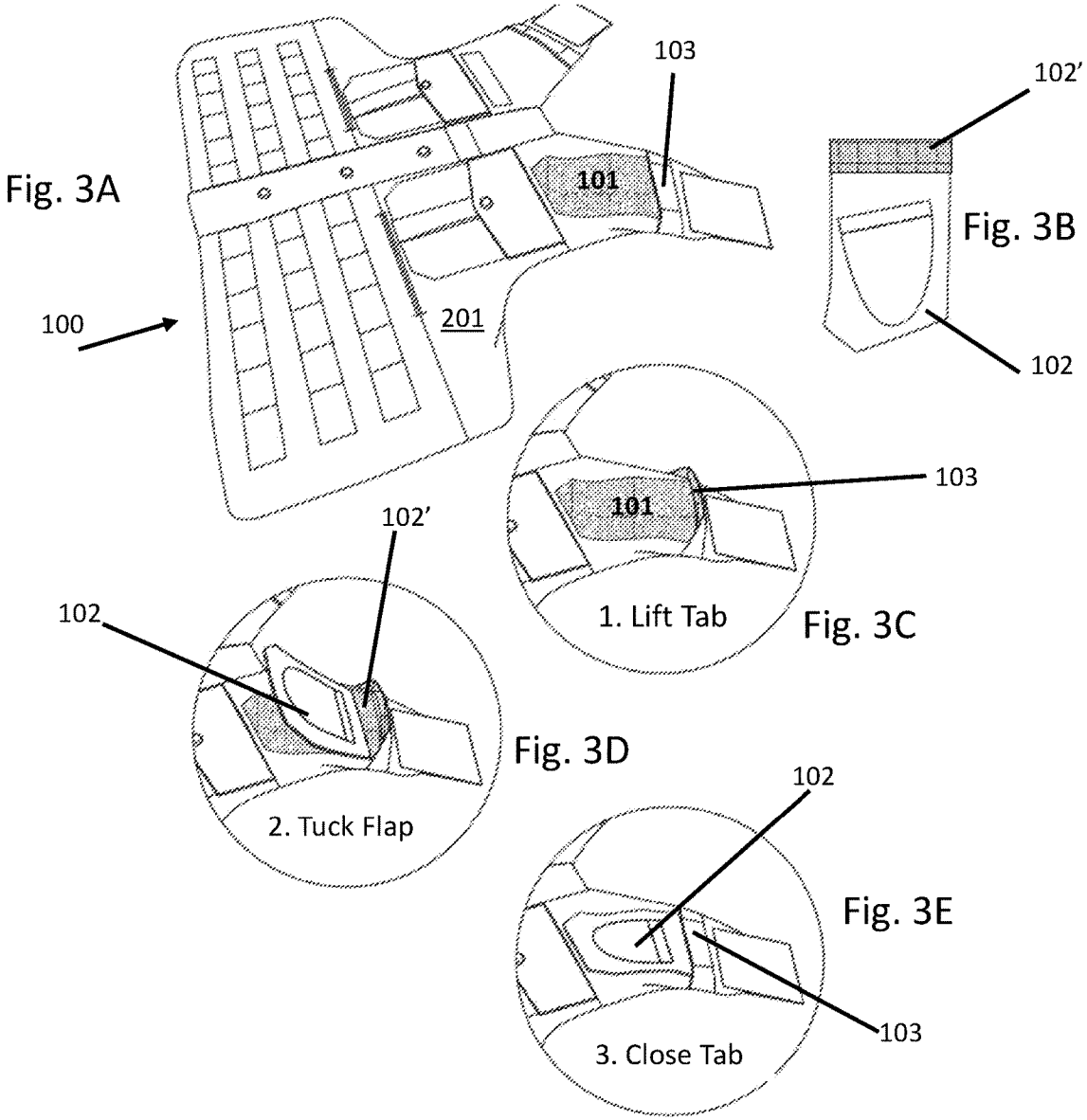
FIG. 3A is a perspective view of the badge system incorporated into an exemplary uniform shirt carrier.
FIG. 3B is a close-up of the badge flap.
FIG. 3C is a close-up of a first step of installing the badge flap on the attachment panel using the retention tab.
FIG. 3D is a close-up of a second step of installing the badge flap on the attachment panel using the retention tab.
FIG. 3E is a close-up of a third step of installing the badge flap on the attachment panel using the retention tab.

Referring to FIGS. 1-3 (including sub-figures), shown is a removable badge system 100 provided on an exemplary uniform shirt carrier 200. The shirt carrier 200 includes a front section 201 and a rear section 202 (not shown). The front and rear sections 201 and 202 are joined at the shoulder area by a right shoulder strap 203 and a left shoulder strap 204. Adjacent to the shoulder straps 203 and 204 on the front section 201 are respective right shoulder area 205 and left shoulder area 206. In some embodiments, the respective right and left shoulder areas 205 and 206 are disposed above the respective right and left breast pocket area 207 and 208 of the front section 201 of the shirt carrier 200.

In some embodiments, the badge system 100 is disposed on one or more the of the right and left shoulder areas 205 and 206 of the front section 201 of the shirt carrier 200. The badge system 100 comprises an attachment panel 101 to which the removable badge flap 102 attaches. In some embodiments, the shape and configuration of the attachment panel 101 closely matches the shape and configuration of the removable badge flap 102 so that when the badge flap 102 is attached to the panel 101 the look is uniform and tidy. The removable badge flap 102 can be attached to the attachment panel 101 by hook-and-loop fastener disposed on its underside—in such case all or a portion of the attachment panel 101 comprises corresponding hook-and-loop material. In other embodiments, the removable badge flap 102 can be attached to the attachment panel 101 by buttons, snaps, magnets or like attachment components.

In some embodiments, adjacent to the top edge of the attachment panel 101 is a retention tab 103. The retention tab 103 may have the appearance and functionality of a mic strap and, in some embodiments, is only partially attached to the right shoulder area 205 (or left shoulder area 206) of the shirt carrier 200. Accordingly, in some embodiments the attachment panel 101 extends underneath the retention tab 103 such that when the removable badge flap 102 is attached to the attachment panel 101, at a least a portion of the top edge of the removable badge flap 102 is secured between the attachment panel 101 and retention tab 103. The use of the retention tab 103 provides additional securement for the removable badge flap 102 and prevents the top edge of the removable badge flap 102 from rolling or crinkling, which could cause the badge flap 102 to get caught or snag on an external object. In some embodiments, the underside of the retention tab 103 includes hook-and-loop fastener corresponding to that of the attachment panel 101 and/or the top side of the badge flap 102 (see FIG. 3B at 102') so that the retention tab 103 can be secured by hook-and-loop engagement to the attachment panel 101 and/or the badge flap 102 to further secure the badge flap 102. The hook-and-loop fastener engagement between the retention tab 103 and the attachment panel 101 is also useful in the event that a badge flap 102 is not used, as it will keep the retention tab 103 secured to minimize snags. One example of installation and use steps are provided in FIGS. 3A-3E.

The removable badge flap 102 is designed to be printable and embroiderable such that the relatively small badges 102 (in comparison to the shirt carrier as a whole) can be manufactured quickly and in large quantities without having to handle the entire shirt carrier. Moreover, the removable nature of the badge flap 102 allows the user to quickly change out one badge flap 102 for another badge flap 102 as desired to change aesthetic or identify a different office, unit, group, department, or the like. In other embodiments, badge flap 102 is configured to removable retain an emblem, medal, shield, or the like by accepting pins or buttons thereof. Accordingly, in the some embodiments the removable badge flap 102 includes one or more slots, button holes, or openings to accommodate corresponding fasteners on such decorative items.

It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A removable badge system adapted for a shirt carrier comprising:

an attachment panel and a badge flap removably attached to the attachment panel;

a retention tab disposed at a top edge of the attachment panel; and wherein only a top edge of the badge flap is sandwiched between the retention tab and the attachment panel.

2. The removable badge system of claim 1, wherein the attachment panel is located on a shoulder area of the shirt carrier.

3. The removable badge system of claim 2, wherein the shoulder area is disposed between a breast pocket area and a shoulder strap of the shirt carrier.

4. The removable badge system of claim 1, wherein the attachment panel includes hook-and-loop fastener material.

5. The removable badge system of claim 4, wherein an underside of the retention tab includes hook-and-loop fastener material corresponding to that of the attachment panel.

6. The removable badge system of claim 5, wherein the top edge of the badge flap includes hook and loop fastener corresponding to that of the underside of the retention tab.

7. The removable badge system of claim 1, wherein the badge flap is printable and able to be embroidered.

* * * * *